United States Patent [19]

Selsted

[11] 4,434,050

[45] Feb. 28, 1984

[54] POOL CLEANING DEVICE FOR ROLLING OPERATION UNDER POOL COVER

[75] Inventor: Walter T. Selsted, Cupertino, Calif.

[73] Assignee: Arneson Products, Inc., Corte Madera, Calif.

[21] Appl. No.: 362,008

[22] Filed: Mar. 25, 1982

[51] Int. Cl.[3] ..... E04H 3/20

[52] U.S. Cl. ..... 210/169; 4/490; 134/167 R; 134/52; 210/242.1

[58] Field of Search ..... 210/169, 242.3, 242.1, 210/416.2; 134/52, 167 R; 4/490

[56] References Cited

U.S. PATENT DOCUMENTS

| | | | |
|---|---|---|---|
| 3,184,764 | 5/1965 | West | 210/169 |
| 3,718,148 | 2/1973 | Gibellina | 4/490 |
| 3,883,366 | 5/1975 | Blumenfeld | 4/490 |
| 4,087,286 | 5/1978 | Sexton et al. | 210/169 |
| 4,141,101 | 2/1979 | Gibellina | 210/169 |

*Primary Examiner*—Peter A. Hruskoci
*Assistant Examiner*—Sharon T. Cohen
*Attorney, Agent, or Firm*—Townsend & Townsend

[57] ABSTRACT

A positive buoyancy programmed motion pool cleaning device is adapted for rolling operation under a floating pool cover so that encountered cover discontinuities such as folds, borders and tears do not interrupt and stop the operation of the device. The pool cleaning device is of the type that has two positive buoyancy portions, these portions typically being positioned fore and aft. At least one and preferably two inverted casters are utilized, the casters each preferably becoming the positive buoyancy portion of the cleaning device. Overall positive buoyancy of the cleaning device causes the caster to ride on the overlying cover at the cover pool interface. The caster is provided with a fairing to reduce drag. A ramp at the leading end of the caster on the upward edge of the inverted fairing allows encountered cover discontinuities to pass smoothly over the fairing to the upwardly exposed caster. The constraint of the overlying pool cover to cause increased tendency of the pool cleaning device to foul pool obstructions, such as ladders and gutter mounted devices, is avoided by providing a housing between the respective casters and a wheel around the rear caster.

7 Claims, 3 Drawing Figures

POOL CLEANING DEVICE FOR ROLLING OPERATION UNDER POOL COVER

This invention relates to pool cleaning, and more particularly a pool cleaning device for rolling movement under the floating cover of a pool.

SUMMARY OF THE PRIOR ART

Floating pool cleaning devices having positive buoyancy are known. One such device is sold under the name "Pool Sweep", a registered trademark of the Arneson Products Corporation of Corte Madera, Ca. These floating devices are given programmed motion to clean the pool. Such a device is illustrated in this patent application.

Specifically, the device is water powered. It includes a water supply, powering the float at the rate of ten gallons per minute at a pressure on the order of thirty pounds per square inch. In operation and through various mechanical drives, all now well known in the art, the pool sweep proceeds in the forward direction for a first and generally longer period of time—on the order of 4 minutes. Serpentine hoses with surface cleaning and abrading oblate spheroidal polishing elements depend downwardly from this floating device. During the moments of forward motion, the pool cleaning device moves to the pool sides. The depending hoses cause dirt to be swept from the sidewalls towards the center of a swimming pool. At the end of the forward cycle, a reverse jet power is applied to the pool cleaning device for a time period in the order of two minutes. The pool cleaning device moves in a backward motion to and towards the center of the pool. At this time the depending hoses sweep dirt to the center of the pool. The disturbance of dirt in the aggregate over many forward and backward motions causes cleaning of the pool to and towards the pool drain.

In such motion, pool sweeps are not precisely programmed as to their path. That is to say they are not confined on racks or railways to cover a particular path. Yet in sum their motion is programmed; by remaining along the pool sidewalls for first periods of time and moving to the center of the pool for other periods of time, a proven and systematic "programmed" cleaning results.

Of late, floating pool covers have not only proven useful but additionally are often times required. These pool covers perform several useful functions.

First, the pool cover provide thermal insulation. Typically swimming pools are heated. During cool hours of the day much heat energy can escape—the greatest loss occurring at the atmospheric interface of the pool. By placing a swimming pool cover on the surface, such losses can be retarded as the cover provides great resistance to heat flow.

Secondly, many covers are adapted to receive heat from the sun and transfer it to the surface of the pool. These covers have the difficulty that on their lower surface at the pool water interface, heat transfers are relatively inefficient.

Finally, pool covers serve the purpose of keeping debris out of the pool in hours when the pool is not in use.

A disadvantage of such covers has been their tendency to grow and foster algae on their under surface. Since the water interface under the cover is typically undisturbed for long periods of time, such locations provide ideal incubation and growth areas for algae.

The operation of pool cleaning devices under such covers has been attempted. In one prior art device, a submarine type device of programmed neutral buoyancy is utilized. Specifically, a neutrally buoyant cleaning device is jet powered in a path through the water. It contains a pressure sensing device. Typically the device is set to remain submerged at a given depth, for example two feet. When the device rises, decreased pressure is sensed, ballasting occurs and the device seeks the programmed level. When the device falls, increased pressure is sensed, deballasting occurs and the device rises. Such pool cleaning devices have proved to be particularly sensitive to minor changes in the pressure sensing devices. Simply stated, while neutral buoyancy is easy to achieve in manned vehicles such as submarines, relying on numerous moving and sensing parts in the harsh chlorinated underwater environment of a pool over long periods of time has proven to be difficult.

STATEMENT OF RELATED PATENT APPLICATION (Not Prior Art)

Assuming that submarine type devices are not used, floating under cover pool cleaning devices have been considered by me.

In one such device, I have used a water bearing between an overlying pool cover and the pool cleaning device. This device has become fouled on cover discontinuities.

Unfortunately, and with all types of covers, discontinuities in the cover surfaces can abound. For example, as covers are placed and replaced from day to day, folds in the placement in such covers occur. These folds can become especially aggravated during the winter months. At such times the pool is typically not heated. The material of the pool cover becomes stiff. Consequently there is no conformance or yielding of the cover as the cleaning device passes under it. Fouling occurs.

STATEMENT OF DISCOVERED PROBLEM

Problems once discovered can constitute invention. Specifically and pursuant to experiment, I have found that pool cover discontinuities can be expected to a far greater degree adjacent the edges of the pool where the pool cover stops or overlaps onto the edges of the pool. Since programmed motion pool cleaning devices spend a large fraction of their time either seeking the pool edges or operating at the pool edges, such pool cleaners seek areas having the highest incidences of discontinuities. This being the case I have discovered that it is essential that encountered discontinuities be accounted for in the operation of such devices.

SUMMARY OF THE INVENTION

A positive buoyancy programmed motion pool cleaning device is adapted for rolling operation under a floating pool cover so that encountered cover discontinuities such as folds, borders and tears do not interrupt and stop the operation of the device. The pool cleaning device is of the type that has two positive buoyancy portions, these portions typically being positioned fore and aft. At least one and preferably two inverted casters are utilized, the casters each preferably becoming the positive buoyancy portion of the cleaning device. Overall positive buoyancy of the cleaning device causes the caster to ride on the overlying cover at the cover pool interface. The caster is provided with a fairing to reduce drag. A ramp at the leading end of the caster on the upward edge of the inverted fairing allows encountered cover discontinuities to pass smoothly over the fairing to the upwardly exposed caster. The constraint of the overlying pool cover to cause the pool cleaning device to foul on pool obstructions, such as ladders and gutter mounted devices, is avoided by providing a housing between the casters and a wheel around the rear caster.

OTHER OBJECTS, FEATURES AND ADVANTAGES OF THE INVENTION

An object of this invention is to disclose in a positive buoyancy, programmed motion cleaning device an inverted caster for rolling on the underside of a pool cover at the water-cover interface. According to this aspect of the invention, the positive buoyancy pool cleaning device is provided with at least one and preferably two inverted casters positioned over the cleaning device. The caster is typically pivotal about central axis and has a trailing roller, typically wide track. This roller trails the motion of the cleaning device and enables substantially frictionless passage under the pool cover. Conventional water jet powering of the pool cleaning device occurs with substantially uninhibited free movement of the pool cleaning device under the pool cover.

An advantage of the invention is that the disclosed caster constitutes a low friction device. Consequently movement of the pool cleaning device at the surface of the water remains substantially unchanged.

Yet another advantage of this invention is that the disclosed upwardly disposed caster fits under and conforms to covers of all kinds. Moreover, virtually any kind of discontinuity in the cover can be encountered without interference with the operation of the pool cleaner. For example folds, tears, rips and even floating borders of the pool covers can be encountered and passed under without interference with the disclosed device.

Yet another advantage of the disclosed apparatus is that operation under virtually any type of pool cover can occur. For example, a pool cover placed in discrete strips on the surface of a pool can be used. Likewise, old and torn covers can have the apparatus of this invention pass under the cover across the tear.

Yet another advantage of the disclosed device is that the jet operation of the cleaning device underneath a cover serves to disturb the water at the cover water interface. Algae is inhibited from growing. Moreover in the case of solar pool covers, heat transfer from the heated cover to the main body of water of the pool is encouraged.

A further advantage of this invention is that the caster can comprise the points of buoyancy for a pool cleaning device. The casters thus define a buoyant metacenter overlying the device center of gravity. Tipping of the pool cleaning device is resisted with high moment.

Yet another object of this invention is to disclose a fairing and integral ramp to facilitate under cover operation of the disclosed inverted caster. According to this aspect of the invention, the leading edge of the fairing is provided with a ramp. This ramp, preferably sloped at 22° to the horizontal, enables the device to encounter cover discontinuities and pass such discontinuities up to the rolling surface of the roller of the inverted caster.

An advantage of the ramp is that folds, rips and even cover borders can be encountered without interruption of the pool cleaning motion.

Yet another object of this invention is the conformance of the pool cleaning device to avoid the increased tendency of such devices to foul when traveling under the constraints of a pool cover. According to this aspect of the invention, the disclosed prior art Arneson Products "Pool Sweep" is provided with a stream lined housing between the respective inverted casters in place and instead of having the two floats connected by a pipe. Moreover, the rear float now comprises an inverted caster circumscribed by a peripheral wheel. This rear peripheral wheel and housing enables the rear inverted caster to encounter and thereafter roll around vertical obstructions, including pool steps, pool sides, pool ladders and the like.

Yet an additional object of this invention is to disclose a stream lined fairing for both containing the caster of this invention and the buoyant portions of the pool cleaning device. According to this aspect of the invention, the forward fairing is co-extensive to the shape of the pool cleaning mechanism depending downwardly from the forward portion of the device. The caster pivots about a centrally mounted vertical axis. Moments produced by buoyancy of the fairing and wheel (these moments being upward) and moments produced by the reactive force of the pool cover down on the roller (this moment being downward) are balanced. No substantial torque is applied to the vertical caster axis.

An advantage of the overall design of the disclosed pool cleaning device is that it produces an aesthetically improved appearance.

A final object of this invention is to disclose a kit which can be utilized to modify existing pool cleaning devices. According to this aspect of the invention, the casters can be provided in "kit" form for attachment to the top of existing pool cleaning devices.

Other objects, features and advantages of this invention will become more apparent after referring to the following specifications and attached drawings in which.

Figure 1:
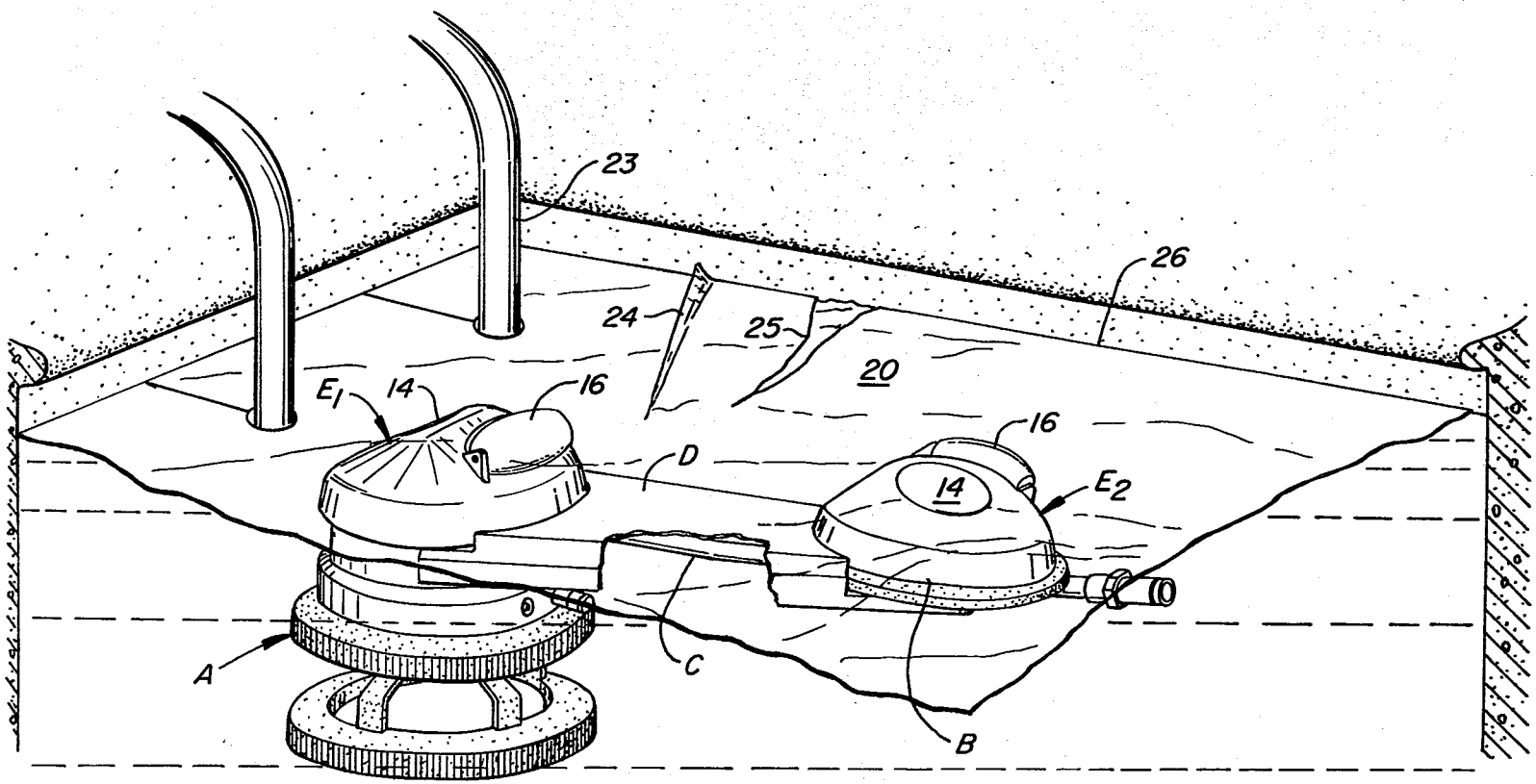
FIG. 1 is a perspective schematic showing a pool with a cover with the pool cleaning device operating under the surface.

Referring to FIG. 1 a perspective view of the floating pool cleaning device of this invention is illustrated. A forward section A and a rear section B are interconnected by a pipe C and stream lined housing D. A first overlying buoyant caster E1 overlies forward section A. A second buoyant caster E2 overlies section B. Each of the respective casters E1, E2 includes a ramp 14, a roller 16 and defines inwardly thereof the buoyant portion of the pool cleaning mechanism. When the ramp 14 and roller 16 encounter a cover 20 and associated discontinuities such as pool mounted ladder 23, cover fold 24, cover tear 25 and/or cover edge 26, under cover pool cleaning continues on a substantially uninterrupted basis.

Figure 2:
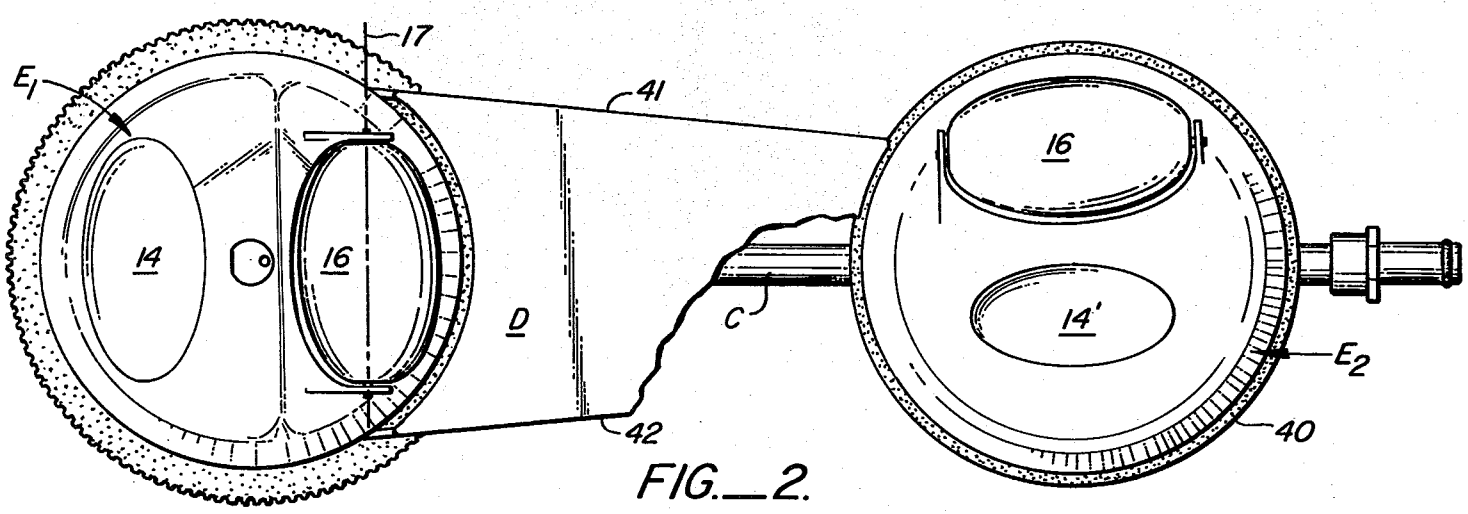
FIG. 2 is a plan view of the pool cleaning device with the housing between the floats partially broken away; and, FIG. 3 is a side elevation in partial section illustrating the pool cleaning device.
Figure 3:
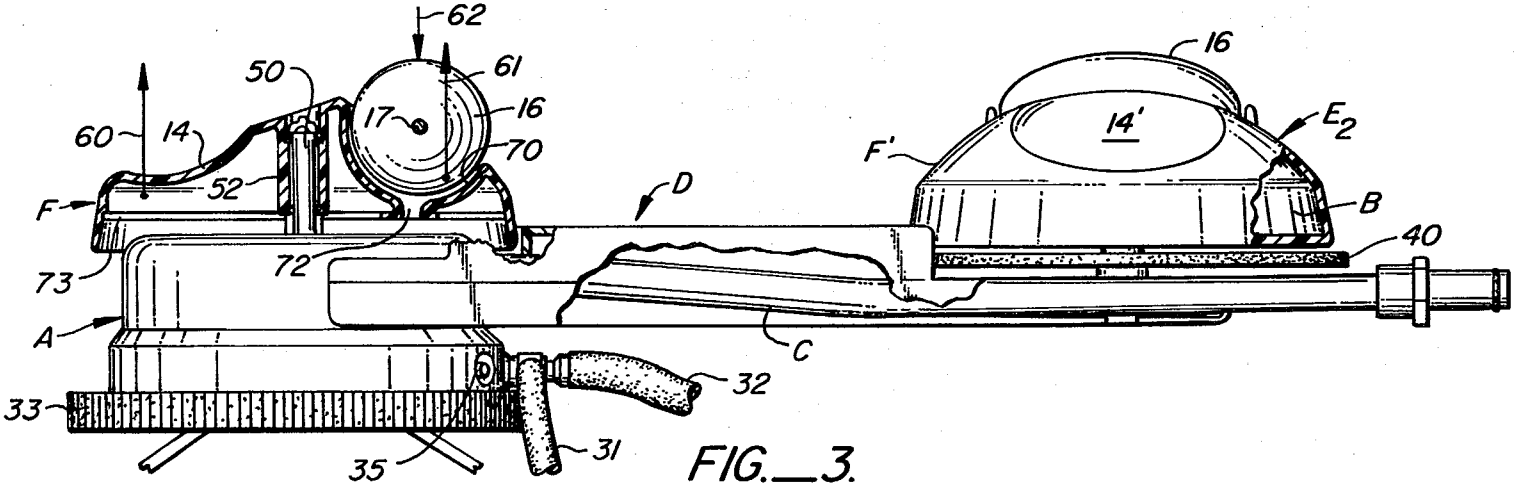

Referring to FIGS. 2 and 3, the particular pool cleaning device here illustrated is sold under the registered trademark "Pool Sweep", by the Arneson Products Corporation of Corte Madera, Calif. This device is given a programmed surface floating motion to clean a pool. It includes sweeping hoses 31, 32 depending from a forward housing A. In this device as currently manufactured, a powered and rotating wheel 33 is disposed at the peripheral and lower portion of the forward edge of float A. Wheel 33 tends to pivot the device away from obstructions such as pool ladder 23 (see FIG. 1). A series of jets, including a forwardly disposed jet (not shown) and a rearwardly disposed jet 35 impart the programmed motion of the pool cleaning device. A conventional pipe C connects forward portion A to a rear portion B.

The operation of this device is well understood and has previously been described. It will not be further discussed herein except to note that the major object of the improvement to be discussed in detail is to provide minimal interference to the device operation. Stated in simple terms, the prior art device operated in an unobstructed fashion at the air-water interface at the top of the pool. The purpose of the present invention is to have uninhibited operation at the pool cover-water interface.

We will first discuss caster E1 overlying forward portion A. Thereafter, we will discuss caster E2 overlying rear portion B and its dissimilarity in the form of peripheral wheel 40. Finally operation of the device with reference to FIG. 1 will be set forth.

Referring to FIG. 3, forward portion A is provided with a central vertical shaft 50. Shaft 50 includes a ball bearing 52. Ball bearing 52 permits free rotation of caster E1 about and above forward portion A so that roller 16 of caster E1 trails shaft 50 in a "wind vane" manner.

The caster is inverted to bear against the underside pool cover 20.

The entire and forward leading edge of the caster housing is provided with a ramp or slope 14. I have experimentally determined that ramp 14 is optimumally sloped in the range of 22°. Slopes from as little as 10° to as much as 40° can be utilized in a broad range with slopes from 18° to 26° being utilized in an intermeditate range. The whole purpose of this slope is to allow encountered discontinuities to pass upward to the rolling periphery of the caster roller 16. Thus, I recess shaft 50 well below the surface of the slope 14 to expose the periphery of roller 16 to the passing cover discontinuity.

Ramp 14 occupies the substantial entirety of the leading portion of caster E1. Moreover, it terminates with just a portion of roller 16 being exposed at its rolling surface. Typically, the elevation of roller 16 over the ramp 14 is chosen so that absent a discontinuity, the cover will depend down to the surface of the water without contacting the ramp 14. When however contact with ramp 14 occurs—such as at a cover discontinuity (fold, rip, border or the like), the cover slides up ramp 14 to the surface of roller 16 without substantially inhibiting the progress of the float.

Buoyancy of the caster fairing about shaft 50 is important. Caster E1 is enclosed within a fairing F, which fairing is essentially stream lined. Like conventional fairings, low drag movement of roller 16 through a fluid, here water, is accommodated.

Fairing F also must accommodate during under pool cover operation buoyant and reactive forces that are not immediately apparent. For example, the sum of buoyant forces in the caster E1 about axis 50 (schematically shown as upward arrows) 61 must be in effect cancelled out by the reactive vector 62 of the cover 20 reacting downwardly on roller 16 incased within fairing F.

As in most conventional fairings, roller 16 is mounted upon a rotational axis 17. This axis is at an elevation so that roller 16 is exposed from a recess 70 in the fairing.

Since caster E1 is inverted, recess 70 is also inverted. Thus it is in an ideal place for debris to accumulate. The upwardly exposed recess 70 is provided with a debris port 72 and a spatial interval between the top of float A and the bottom 73 of the fairing. Accumulated debris between the roller 16 and the recess 70 can pass out port 72 around the upper surface of the housing A and hence to the bottom of the pool for conventional sweeping.

The description of float E2 will not be repeated. Caster E2 is centrally positioned over rear portion B on a vertical axis (not shown). Its construction and operation is identical to that of caster E1.

The bottom of caster E2 is surrounded by a wheel 40. Moreover between the respective portions A and B there is provided an expansive vane type housing D.

I have found that with operation under pool covers, the tendency of floating pool cleaning devices to hang up on obstructions is increased and/or magnified. This being the case, the presence of wheel 40 allows the device to pass around vertical obstructions and prevents fouling. Housing D at side edges 41, 42 decreases the chance of under pool cover cleaning device fouling on vertical obstructions between the floating sections. While these devices are not necessary for the operation of my device, I prefer them.

Returning to FIG. 1, the operation of this apparatus can be easily understood. Specifically, the rollers 16 of the respective casters E1, E2 bear against the underside pool cover 20. In encountering vertical obstacles, such as ladder 23, peripheral wheel 40 on caster E2 over rear portion B and the side edges of housing D at border 41, 42 assure smooth passage. At the same time in the encounter of obstacles such as fold 24, tear 25, and pool cover edge 26, the ramps 14 and rollers 16 enable the pool cleaning device to pass smoothly. It is important to note that the overall configuration of the inverted casters of this invention even enables passage of the device from an uncovered portion of the pool to a covered portion of the pool.

It will be apparent that this invention may be modified only as restricted by the appended claims. For example, the rear portion B may consist only of the caster. I have illustrated the inverted casters as being the buoyant portions of the device. This is preferred but not required. Moreover, the disclosed invention can constitute a kit for the modification of existing devices such as the product illustrated herein.

What is claimed:

1. In a pool cleaning apparatus having positive buoyancy and propelled motion when positioned in a swimming pool, apparatus for permitting unimpeded motion under a floating pool cover, comprising: at least one inverted caster in overlying arrangement to said pool cleaning apparatus, said caster having a substantially vertical axis for pivotal movement of said caster around said axis at least one of said casters including a ramp to permit said caster to move under obstructions in said cover; and a roller mounted to said caster to permit said pool cleaning apparatus to move under and in contact with said cover.

2. The invention of claim 1 and wherein at least one said caster includes a fairing for containing the caster and the buoyant portions of said pool cleaning apparatus.

3. The invention of claim 1 and wherein said pool cleaning apparatus includes first and second floats with first and second inverted casters thereover.

4. The invention of claim 3 and including a streamlined housing connecting said first and second casters.

5. In combination with a water filled swimming pool containing a floating vehicle for movement on the surface and cleaning said pool and a cover disposed over the surface of said pool and floating vehicle, the improvement in said floating vehicle including: at least one inverted caster in overlying arrangement to said floating vehicle, said caster having a substantially vertical axis for pivotal movement of said caster against the under surface of said cover said caster including a ramp to permit said caster to move under obstructions in said cover; and a roller mounted to said caster for trailing said axis in contact with the underside of said pool cover in weather vane fashion.

6. The invention of claim 5 wherein said caster includes a stream lined fairing for containing the caster and the buoyant portions of said floating vehicle.

7. The invention of claim 6 wherein one of said casters includes a roller in a recess of said caster, said recess defining an aperture for exit of captured debris.

* * * * *